US009771941B2

(12) United States Patent
Yoshioka et al.

(10) Patent No.: US 9,771,941 B2
(45) Date of Patent: Sep. 26, 2017

(54) STRUCTURE OF A VENTILATED PASSAGE FOR VENTILATING THE INSIDE OF THE MOTOR OF AN ELECTRIC PUMP APPARATUS

(71) Applicant: JTEKT CORPORATION, Osaka-shi (JP)

(72) Inventors: Yuichi Yoshioka, Yao-shi (JP); Sayaka Sugano, Nagoya (JP)

(73) Assignee: JTEKT CORPORATION, Osaka-shi (JP)

( * ) Notice: Subject to any disclaimer, the term of this patent is extended or adjusted under 35 U.S.C. 154(b) by 286 days.

(21) Appl. No.: 14/471,695

(22) Filed: Aug. 28, 2014

(65) Prior Publication Data

US 2015/0071796 A1 Mar. 12, 2015

(30) Foreign Application Priority Data

Sep. 12, 2013 (JP) ..... 2013-189175

(51) Int. Cl.

| | |
|---|---|
| ***F04D 25/06*** | (2006.01) |
| ***F04D 29/58*** | (2006.01) |
| ***F04C 2/08*** | (2006.01) |
| ***F04C 2/10*** | (2006.01) |
| ***F04C 15/00*** | (2006.01) |

(52) U.S. Cl.

CPC ..... *F04D 25/06* (2013.01); *F04C 2/086* (2013.01); *F04C 15/0096* (2013.01);

(Continued)

(58) Field of Classification Search

CPC ..... F04D 25/06; F04D 29/58; F04D 29/40; F04D 29/406; F04C 2/086; F04C 2/10;

(Continued)

(56) References Cited

U.S. PATENT DOCUMENTS 4,721,440 A 1/1988 Hurst
6,197,447 B1 * 3/2001 Purdy ..... H01M 2/1077 429/175

(Continued)

FOREIGN PATENT DOCUMENTS

DE 20 2004 020 959 U1 8/2006
JP H10-215537 A 8/1998

(Continued)

OTHER PUBLICATIONS

Extended European Search Report issued Oct. 29, 2014 in Patent Application No. 14183880.5.

(Continued)

*Primary Examiner* — Devon Kramer
*Assistant Examiner* — Christopher Brunjes
(74) *Attorney, Agent, or Firm* — Oblon, McClelland, Maier & Neustadt, L.L.P.

(57) ABSTRACT

A closing cover integrally includes a cover main body, and a ventilation cap body. The ventilation cap body has a connecting portion that is integrally connected to the cover main body, and at least one ventilation passage hole that is disposed in the connecting portion to perpendicularly extend, and has a depth smaller than a plate thickness of the cover main body. A ventilation recessed portion is formed at a location that is positioned on an inner surface of the ventilation cap body of the closing cover. An inner wall surface defining the ventilation recessed portion is formed in such a shape that a deep side of the ventilation passage hole is opened to the inner wall surface defining the ventilation recessed portion to form a ventilation passage. A ventilation filter is installed on an inner opening portion of the ventilation recessed portion.

5 Claims, 3 Drawing Sheets

(52) U.S. Cl.
CPC ..... *F04D 29/58* (2013.01); *F04C 2/10* (2013.01); *F04C 2240/30* (2013.01)

(58) Field of Classification Search
CPC ..... F04C 13/007; F04C 13/0053; F04C 15/0096; F04C 2240/30; F04B 39/12; F04B 39/14; F04B 53/16; F04B 53/22
See application file for complete search history.

(56) References Cited

U.S. PATENT DOCUMENTS

| | | | | |
|---|---|---|---|---|
| 2003/0151315 | A1 | 8/2003 | Choi et al. | |
| 2011/0027078 | A1* | 2/2011 | Pan | F04D 25/08 415/206 |
| 2012/0230850 | A1* | 9/2012 | Kawano | F04C 11/008 417/410.1 |

FOREIGN PATENT DOCUMENTS

| | | | |
|---|---|---|---|
| JP | 2001044735 | A * | 2/2001 |
| JP | 2003-244895 | A | 8/2003 |
| JP | 2012-26309 | A | 2/2012 |
| JP | 2012-110176 | | 6/2012 |
| JP | 2013-87636 | | 5/2013 |
| JP | 2013087636 | A * | 5/2013 |

OTHER PUBLICATIONS

Notice of Reasons for the Rejection dated Apr. 18, 2017 in Japanese Patent Application No. JP 2013-189175.

* cited by examiner

STRUCTURE OF A VENTILATED PASSAGE FOR VENTILATING THE INSIDE OF THE MOTOR OF AN ELECTRIC PUMP APPARATUS

INCORPORATION BY REFERENCE

The disclosure of Japanese Patent Application No. 2013-189175 filed on Sep. 12, 2013 including the specification, drawings and abstract, is incorporated herein by reference in its entirety.

BACKGROUND OF THE INVENTION

1. Field of the Invention

The present invention relates to an electric pump apparatus that includes a pump portion including a pump housing to which constituent members of a pump are fitted, and a motor portion including a motor housing to which constituent members of an electric motor for driving the pump are fitted.

2. Description of Related Art

There has been known an electric pump apparatus of the above-mentioned type, in which a ventilation cap for forming a ventilation passage for ventilation is disposed at a predetermined position in a closing cover installed on an opening portion of a motor housing, as described in, for example, Japanese Patent Application Publication No. 2013-87636 and Japanese Patent Application Publication No. 2012-110176. In the electric pump apparatus described in Japanese Patent Application Publication No. 2013-87636, the ventilation cap formed separately from the closing cover is fixed to the opening portion formed at a predetermined position in the closing cover, and thus the ventilation passage for ventilation is formed between the opening portion of the closing cover and the ventilation cap. In the electric pump apparatus described in Japanese Patent Application Publication No. 2012-110176, the ventilation cap formed separately from the closing cover is detachably installed on the opening portion of the closing cover, and thus the ventilation passage is formed between the opening portion of the closing cover and the ventilation cap.

In Japanese Patent Application Publication No. 2013-87636 and Japanese Patent Application Publication No. 2012-110176, the closing cover and the ventilation cap are formed separately from each other, and the ventilation cap needs to be installed on the opening portion of the closing cover. Thus, the number of components and man-hours required for assembly increase, and accordingly, the cost increases.

SUMMARY OF THE INVENTION

An object of the present invention is to provide an electric pump apparatus in which a cover main body and a ventilation cap body of a closing cover are integrally formed to reduce the number of components and man-hours required for assembly, thereby reducing the cost.

According to an aspect of the present invention, there is provided an electric pump apparatus including a pump portion including a pump housing to which a constituent member of a pump is fitted; and a motor portion including a motor housing to which a constituent member of an electric motor for driving the pump is fitted, wherein one end of the motor housing is fitted to the pump housing in such a manner that a sealing member is interposed between the one end of the motor housing and the pump housing, wherein a closing cover is installed on an opening portion at the other end of the motor housing, wherein the closing cover integrally includes a cover main body, and a ventilation cap body that forms a ventilation passage for ventilation for an inside of the motor housing, wherein the ventilation cap body has a connecting portion that is integrally connected to the cover main body, and at least one ventilation passage hole that is disposed in the connecting portion to perpendicularly extend in a direction from an outer surface to an inner surface of the cover main body, and has a depth smaller than a plate thickness of the cover main body, wherein a ventilation recessed portion is formed at a location that is positioned in an inner surface side of the cover main body and that is positioned on an inner surface of the ventilation cap body, wherein an inner wall surface defining the ventilation recessed portion is formed in such a shape that a deep side of the ventilation passage hole is opened to the inner wall surface defining the ventilation recessed portion to form the ventilation passage, and wherein a ventilation filter is installed on an inner opening portion of the ventilation recessed portion.

BRIEF DESCRIPTION OF THE DRAWINGS

The foregoing and further features and advantages of the invention will become apparent from the following description of example embodiments with reference to the accompanying drawings, wherein like numerals are used to represent like elements and wherein.

DETAILED DESCRIPTION OF EMBODIMENTS

An embodiment of the present invention will be described.

Figure 1:
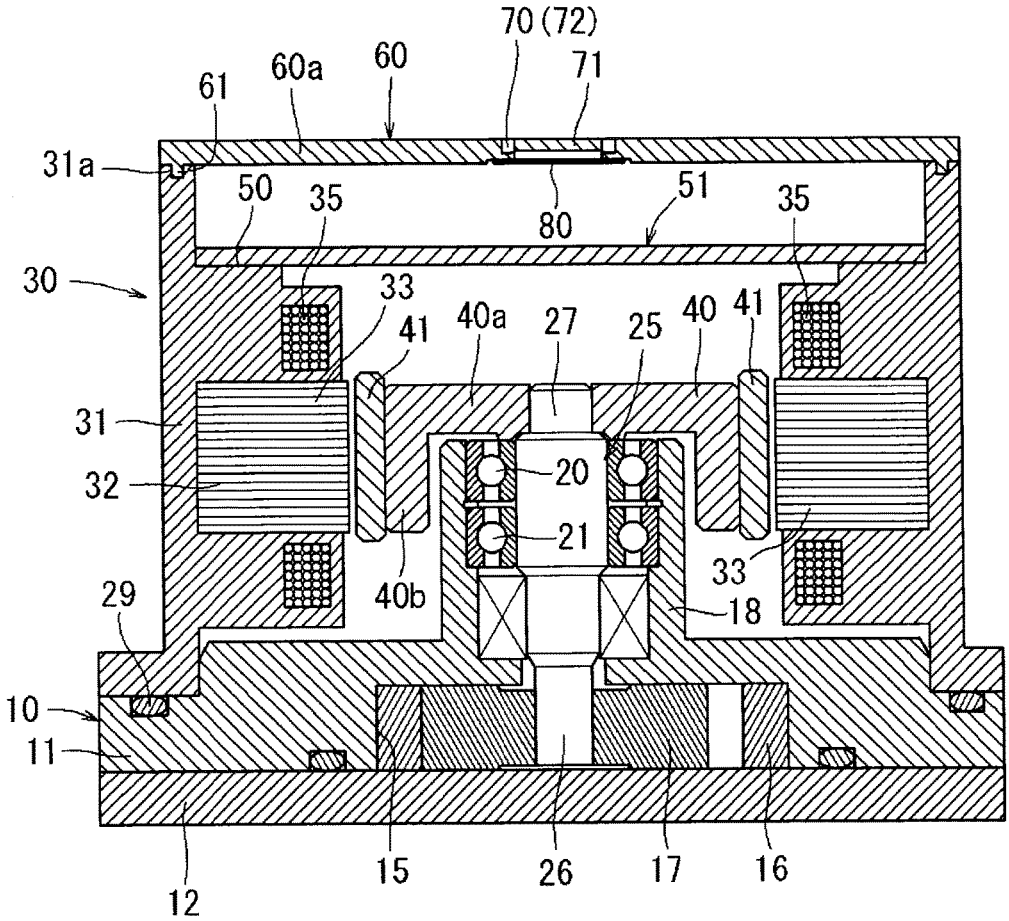
FIG. 1 is a longitudinal sectional view illustrating an electric pump apparatus according to an embodiment of the present invention.

The embodiment of the present invention will be described with reference to the accompanying drawings. As described in FIG. 1, an electric pump apparatus includes a pump portion 10 and a motor portion 30. The pump portion 10 includes a pump housing 11 to which constituent members of a pump are fitted. The motor portion 30 includes a motor housing 31 to which constituent members of an electric motor for driving the pump are fitted.

In the embodiment, an outer gear 16 and an inner gear 17 are provided in a pump chamber 15 formed between the pump housing 11 and a pump plate 12 attached to one end of the pump housing 11. The outer gear 16 is a constituent member of the pump. The inner gear 17 has external teeth, and rotates with the external teeth meshing with internal teeth of the outer gear 16, thereby performing a pumping operation. A cylindrical bearing housing 18 protrudes from a central portion of an end face of the pump housing 11, the end face being located on a side opposite to the pump plate 12. A motor shaft 25 is rotatably supported in the bearing housing 18 via rolling bearings 20, 21. A gear shaft portion 26 is formed at one end of the motor shaft 25, and is fitted in a center portion of the inner gear 17 in such a manner that a torque can be transmitted.

The motor housing 31 is made of a thermoplastic resin material, and has a cylindrical shape. One end of the motor housing 31 is fitted to the pump housing 11 in such a manner that a sealing member such as an O-ring 29 is interposed between the end of the motor housing 31 and the pump housing 11. A rotor 40 is fitted to a rotor shaft portion 27 in such a manner that torque can be transmitted. The rotor shaft portion 27 is the other end of the motor shaft 25. The rotor 40 has a disc portion 40*a* and a cylindrical portion 40*b*. A fitting hole is formed at the center of the disc portion 40*a*, and the rotor shaft portion 27 is fitted into the fitting hole in such a manner that torque can be transmitted. The cylindrical portion 40*b* extends integrally from an outer circumference of the disc portion 40*a* along an outer circumference of the bearing housing 18. A plurality of permanent magnets 41 is provided at predetermined intervals on an outer circumferential surface of the cylindrical portion 40*b*.

A stator 32 is provided in the motor housing 31, and has a stator core 33 made of stacked steel sheets. A coil 35 is wound around the stator core 33 in an insulating state. The motor shaft 25, the rotor 40, the stator core 33, the stator 32, and the coil 35 are the constituent members of the motor. A board attachment portion 50 is formed in the vicinity of an opening at the other end of the motor housing 31. A control board 51 for controlling a motor is attached to the board attachment portion 50. A recessed annular groove 31*a* is provided in an end face at the other end of the motor housing 31, and a closing cover 60, which will be described later, is fixed to the annular groove 31*a*.

Figure 2:
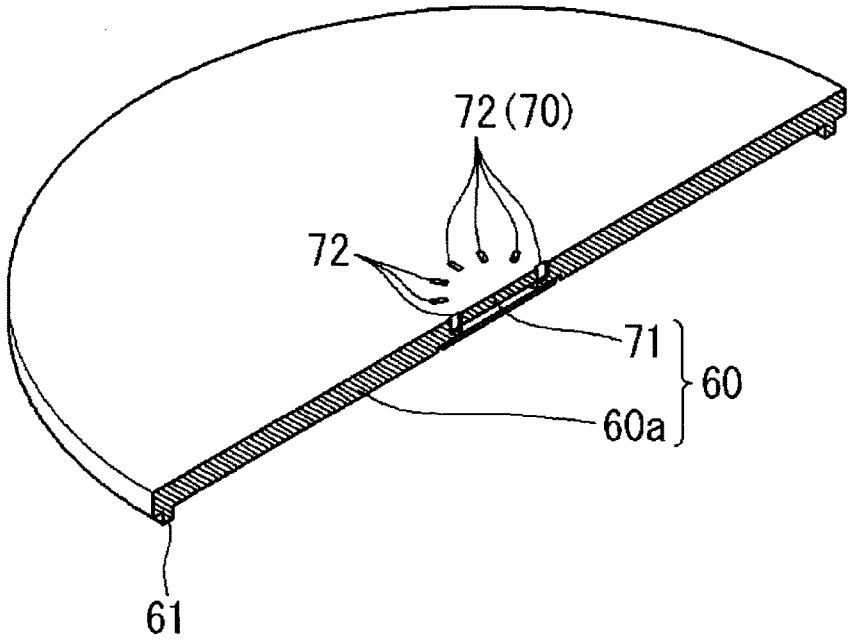
FIG. 2 is a perspective view illustrating a closing cover in the embodiment in a cutaway manner.
Figure 3:
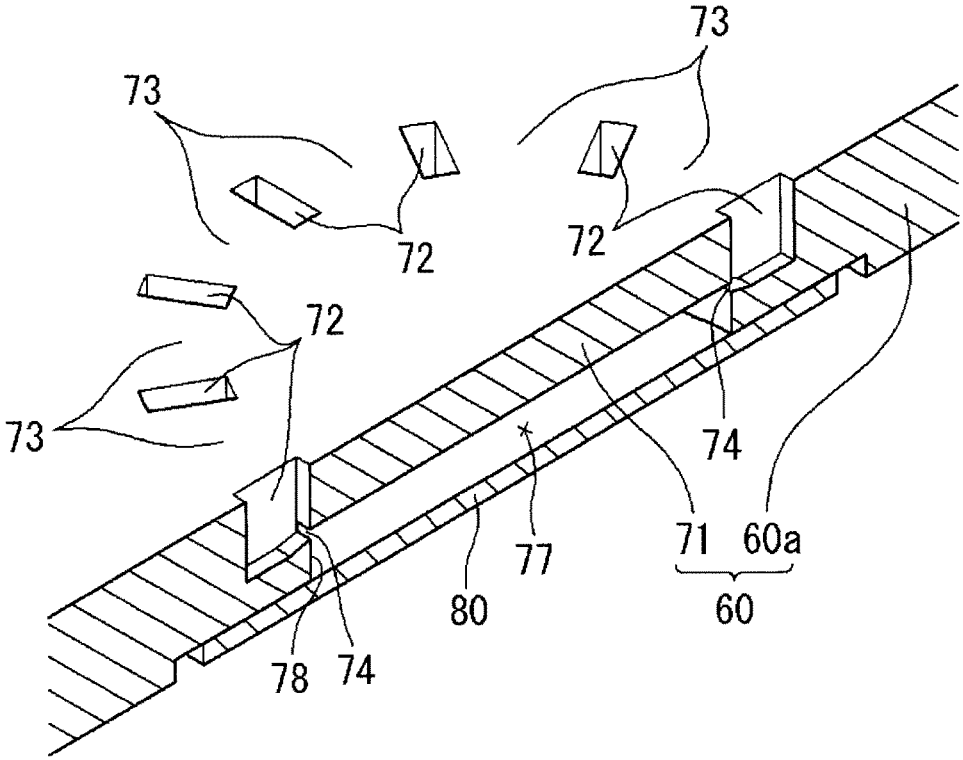
FIG. 3 is a perspective view illustrating a relation between a cover main body and a ventilation cap body of the closing cover in the embodiment in an enlarged manner.
Figure 4:
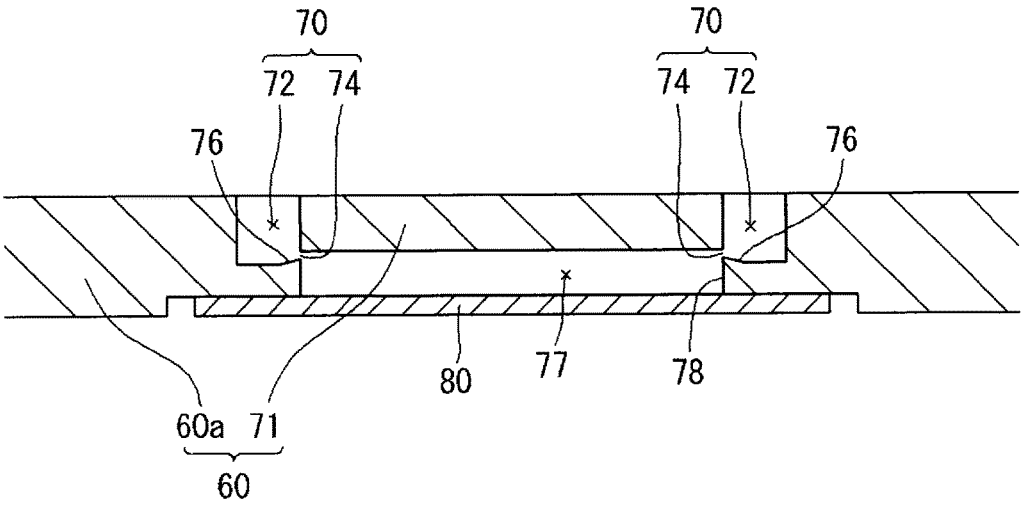
FIG. 4 is a longitudinal sectional view illustrating the relation between the cover main body and the ventilation cap body of the closing cover in the embodiment in the enlarged manner.

An opening portion at the other end of the motor housing 31 is closed by the closing cover 60. The closing cover 60 is made of a thermoplastic resin material compatible with the resin material of which the motor housing 31 is formed. The closing cover 60 integrally includes a cover main body 60*a* and a ventilation cap body 71. The ventilation cap body 71 forms a ventilation passage 70 for ventilation for the inside of the motor housing 31. As illustrated in FIGS. 2 to 4, the cover main body 60*a* has a disc shape and has such a size as to close the opening portion at the other end of the motor housing 31. An annular protruding ring 61 is formed in a circumferential edge portion of a lower surface of the cover main body 60*a*, and is fitted into the annular groove 31*a* in the end face at the other end of the motor housing 31. The annular protruding ring 61 is integrally joined to the annular groove 31*a* by spin welding, vibration welding, or the like, in a state where the annular protruding ring 61 is fitted into the annular groove 31*a*. Accordingly, the closing cover 60 is integrally fixed to the motor housing 31.

As illustrated in FIGS. 2 to 4, the ventilation cap body 71 has a plurality of connecting portions 73 and a plurality of ventilation passage holes 72. The connecting portions 73 are arranged at intervals of a predetermined angle in a circumferential direction, and are integrally connected to the cover main body 60*a*. Each of the ventilation passage holes 72 is disposed between the connecting portions 73 to perpendicularly extend in a direction from an outer surface (an upper surface) to an inner surface (a lower surface) of the cover main body 60*a*, and has a depth smaller than the plate thickness of the cover main body 60*a*. The ventilation passage holes 72 are arranged in a radial manner. A ventilation recessed portion 77 is formed at a location that is positioned in the inner surface side of the cover main body 60*a* and that is positioned on an inner surface of the ventilation cap body 71. An inner circumferential wall surface 78 defining the ventilation recessed portion 77 is formed as a cylindrical surface having such an inside diameter that a deep side of each of the ventilation passage holes 72 is opened to the inner circumferential wall surface 78 defining the ventilation recessed portion 77 via an opening portion 74 to form the ventilation passage 70.

In the embodiment, as illustrated in FIG. 3, each of the ventilation passage holes 72 has a slit shape that is elongated in a radial direction of the ventilation cap body 71. As illustrated in FIG. 4, in a bottom face of each of the ventilation passage holes 72, a slope surface 76 is formed in the vicinity of a radially inner end portion in such a manner that the position of the radially inner end portion is higher than that of a radially outer end portion. A ventilation filter 80 is installed on a portion around an inner opening portion of the ventilation recessed portion 77 so as to close the opening portion of the ventilation recessed portion 77. The ventilation filter 80 has a waterproof property and a property of allowing air ventilation.

In the electric pump apparatus according to the embodiment having the above-mentioned configuration, the closing cover 60, which is installed on the opening portion at the other end of the motor housing 31, integrally includes the cover main body 60*a* and the ventilation cap body 71. The ventilation cap body 71 forms the ventilation passage 70 for ventilation for the inside of the motor housing 31. The ventilation cap body 71 has the connecting portions 73, and the ventilation passage holes 72. The connecting portions 73 are integrally connected to the cover main body 60*a*. Each of the ventilation passage holes 72 is disposed between the connecting portions 73 to perpendicularly extend in the direction from the outer surface (the upper surface) to the inner surface (the lower surface) of the cover main body 60*a*, and has a depth smaller than the plate thickness of the cover main body 60*a*. The deep side of each of the ventilation passage holes 72 is opened to the inner circumferential wall surface 78 defining the ventilation recessed portion 77 via the opening portion 74, the inner circumferential wall surface 78 being a cylindrical surface. Thus, the ventilation passage 70 is formed. The ventilation recessed portion 77 is formed at the location that is positioned in the inner surface side of the cover main body 60*a* and that is positioned on the inner surface of the ventilation cap body 71. Thus, it is possible to provide the closing cover 60 in which the cover main body 60*a* and the ventilation cap body 71 are integrally formed, and which has the ventilation passage 70.

Figure 5:
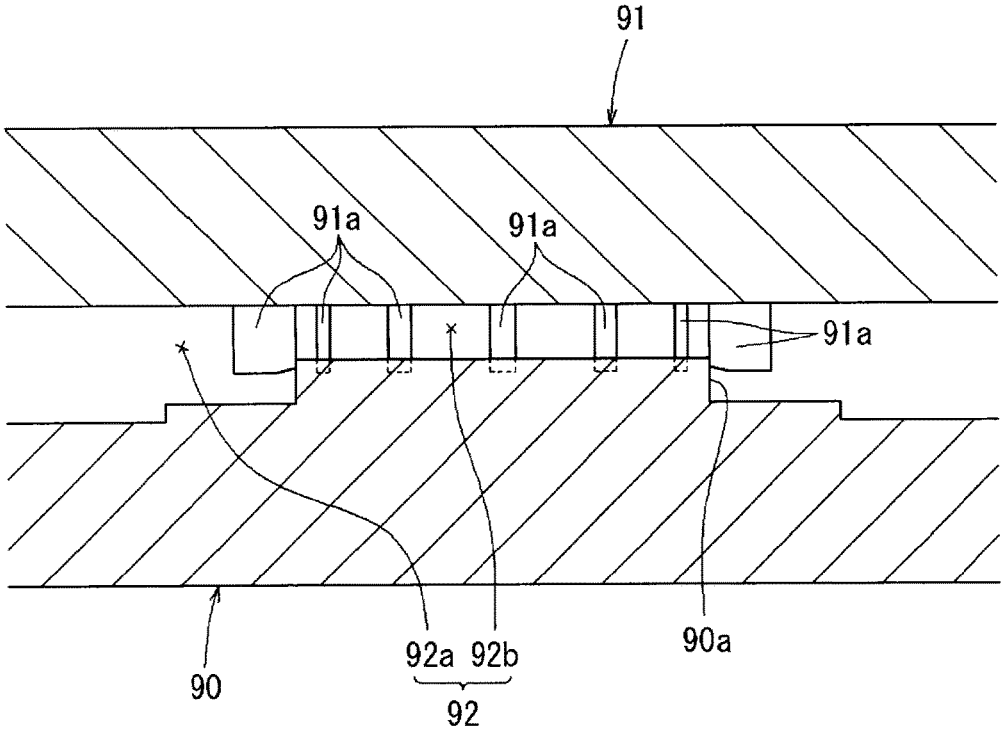
FIG. 5 is an explanatory view illustrating molding dies for integrally forming the cover main body and the ventilation cap body of the closing cover.

That is, as illustrated in FIG. 5, a first molding die 90 and a second molding die 91 are used to form the closing cover 60 by injection molding. A protruding portion 90*a* for forming the ventilation recessed portion 77 is provided on a die surface of the first molding die 90. A plurality of column portions 91*a* for forming the ventilation passage holes 72 is provided to protrude from a die surface of the second molding die 91. As illustrated in FIG. 5, when the first molding die 90 and the second molding die 91 are clamped together, an outer circumferential surface of the protruding portion 90*a* of the first molding die 90 is brought into contact with, and overlaps the inside diameter side surface of each of the column portions 91*a* of the second molding die 91 in such a manner that a contact portion therebetween is equivalent to the opening portion 74 formed at the deep side of each of the ventilation passage holes 72. Accordingly, a cavity 92 is formed between the respective die surfaces of the first molding die 90 and the second molding die 91. The cavity 92 has a cavity portion 92*a* corresponding to the cover main body 60*a* of the closing cover 60, and a cavity portion 92*b* corresponding to the ventilation cap body 71, the cavity portion 92*a* and the cavity portion 92*b* being continuous with each other. A melted thermoplastic resin material is injected into the cavity 92 formed between the first molding die 90 and the second molding die 91, and the cavity 92 is filled with the melted thermoplastic resin material. Thus, it is possible to easily manufacture the closing cover 60 in which the cover main body 60*a* and the ventilation cap body 71 are integrally formed.

In the embodiment, each of the ventilation passage holes 72 has a slit shape that is elongated in the radial direction of the ventilation cap body 71. Therefore, for example, when high-pressure water for vehicle washing or the like is sprayed onto the opening portions of the ventilation passage holes 72, a small amount of water is sprayed in a direction parallel to a hole direction of the ventilation passage holes 72, and a large amount of water collides with hole wall surfaces of the ventilation passage holes 72. That is, the high-pressure water sprayed onto the opening portions of the ventilation passage holes 72 can be prevented from directly reaching the opening portion 74 at the deep side of each of the ventilation passage holes 72, and the ventilation filter 80 can be protected from the high-pressure water.

In the bottom face of each of the ventilation passage holes 72, the position of the radially inner end portion is higher than that of the radially outer end portion. Accordingly, even when water reaches the bottom face of each of the ventilation passage holes 72, the water is stopped by the slope surface 76 at the radially inner end portion of the bottom face of the ventilation passage hole 72, and can collect at a reservoir formed by the bottom face of the of the ventilation passage holes 72 located farther from the ventilation recessed portion. The water can thereby be prevented from intruding into the ventilation recessed portion.

The present invention is not limited to the embodiment, and the present invention can be implemented in various forms without departing from the scope of the present invention. For example, in the embodiment, the ventilation cap body 71 has the connecting portions 73 that are arranged at intervals of the predetermined angle in the circumferential direction, and are integrally connected to the cover main body 60*a*; and the ventilation passage holes 72, each of which is disposed between the connecting portions 73 to perpendicularly extend in the direction from the outer surface to the inner surface of the cover main body 60*a*, and has a depth smaller than the plate thickness of the cover main body 60*a*. However, the connecting portions 73 or the ventilation passage holes 72 may be disposed at any angular intervals. The number of connecting portions 73 or the ventilation passage holes 72 is not limited to a plural number, and at least one is required in the present invention. The ventilation recessed portion 77, which is formed at the location that is positioned in the inner surface side of the cover main body 60*a* and that is positioned on the inner surface of the ventilation cap body 71, may not be defined by a cylindrical surface. As long as the ventilation recessed portion 77 is formed in such a shape that the deep side of at least one ventilation passage hole 72 is opened to the inner wall surface defining the ventilation recessed portion 77, the ventilation recessed portion 77 may have any shape in the present invention.

According to the present invention, the cover main body and the ventilation cap body of the closing cover are integrally formed. Accordingly, it is possible to reduce the number of components, and man-hours required for assembly. Thus, the present invention has a great effect in cost reduction.

What is claimed is:

1. An electric pump apparatus comprising:

a pump portion including a pump housing to which a constituent member of a pump is fitted; and a motor portion including a motor housing to which a constituent member of an electric motor for driving the pump is fitted, wherein one end of the motor housing is fitted to the pump housing in such a manner that a sealing member is interposed between the one end of the motor housing and the pump housing, wherein a closing cover is installed on an opening portion at the other end of the motor housing, wherein the closing cover integrally includes a cover main body, and a ventilation cap body that forms a ventilation passage for ventilation for an inside of the motor housing, wherein the ventilation cap body has a connecting portion that is integrally connected to the cover main body, and at least one ventilation passage hole that is disposed in the connecting portion to perpendicularly extend in a direction from an outer surface toward an inner surface of the cover main body, which ventilation passage hole has a bottom face which is a surface of the ventilation passage hole that is farthest from the outer surface, and which ventilation passage hole has a depth smaller than a plate thickness of the cover main body, wherein a ventilation recessed portion is formed at a location that is positioned in an inner surface side of the cover main body and that is positioned on an inner surface of the ventilation cap body, wherein an inner wall surface defining the ventilation recessed portion is formed in such a shape that a deep side of the ventilation passage hole is opened to the inner wall surface defining the ventilation recessed portion to form the ventilation passage, wherein a ventilation filter is installed on an inner opening portion of the ventilation recessed portion, and wherein in the bottom face of the ventilation passage hole, a position of a radially inner end portion of the bottom face is positioned closer to the outer surface of the cover main body than is a radially outer end portion of the bottom face, wherein a portion of the bottom face of the ventilation passage hole which is closer to the ventilation recessed portion is sloped upwardly toward the ventilation recessed portion to form, in a portion of the bottom face of the ventilation passage hole which is farther from the ventilation recessed portion, a reservoir for retaining in the ventilation passage hole moisture that has entered the ventilation passage hole.

2. The electric pump apparatus according to claim 1, wherein the ventilation cap body has a plurality of the connecting portions that is disposed at angular intervals in a circumferential direction, and is integrally connected to the cover main body, and a plurality of the ventilation passage holes each of which is disposed between the connecting portions to perpendicularly extend in the direction from the outer surface to the inner surface of the cover main body, and has a depth smaller than the plate thickness of the cover main body, wherein the ventilation recessed portion is formed at the location that is positioned in the inner surface side of the cover main body and that is positioned on the inner surface of the ventilation cap body, wherein an inner circumferential wall surface defining the ventilation recessed portion is formed as a cylindrical surface having such an inside diameter that a deep side of each of the ventilation passage holes is opened to the inner circumferential wall surface defining the ventilation recessed portion to form the ventilation passage, and wherein the ventilation filter is installed on the inner opening portion of the ventilation recessed portion.

3. The electric pump apparatus according to claim 2, wherein the ventilation passage hole has a slit shape that is elongated in a radial direction of the ventilation cap body.

4. The electric pump apparatus according to claim 1, wherein the ventilation passage hole has a slit shape that is elongated in a radial direction of the ventilation cap body.

5. An electric pump apparatus comprising:

a pump portion including a pump housing to which a constituent member of a pump is fitted; and a motor portion including a motor housing to which a constituent member of an electric motor for driving the pump is fitted, wherein one end of the motor housing is fitted to the pump housing in such a manner that a sealing member is interposed between the one end of the motor housing and the pump housing, wherein a closing cover is installed on an opening portion at the other end of the motor housing, wherein the closing cover integrally includes a cover main body, and a ventilation cap body that forms a ventilation passage for ventilation for an inside of the motor housing, wherein the ventilation cap body has a connecting portion that is integrally connected to the cover main body, and at least one ventilation passage hole that is disposed in the connecting portion to perpendicularly extend in a direction from an outer surface toward an inner surface of the cover main body, which ventilation passage hole has a bottom face which is a surface of the ventilation passage hole that is farthest from the outer surface, and which ventilation passage hole has a depth smaller than a plate thickness of the cover main body, wherein a ventilation recessed portion is formed at a location that is positioned in an inner surface side of the cover main body and that is positioned on an inner surface of the ventilation cap body, wherein an inner wall surface defining the ventilation recessed portion is formed in such a shape that a deep side of the ventilation passage hole is opened to the inner wall surface defining the ventilation recessed portion to form the ventilation passage, wherein a ventilation filter is installed on an inner opening portion of the ventilation recessed portion, and wherein in the bottom face of the ventilation passage hole, a position of a radially inner end portion of the bottom face is positioned closer to the outer surface of the cover main body than is a radially outer end portion of the bottom face, wherein the bottom face of the ventilation passage hole is sloped upwardly toward the ventilation recessed portion to form, in a portion of the bottom face of the ventilation passage hole which is farther from the ventilation recessed portion, a reservoir for retaining in the ventilation passage hole moisture that has entered the ventilation passage hole, and wherein the inner radial wall of the ventilation passage is in line with the outer radial wall of the ventilation recessed portion.

* * * * *